US008593243B2

(12) United States Patent
Lee et al.

(10) Patent No.: US 8,593,243 B2
(45) Date of Patent: Nov. 26, 2013

(54) PULSED MAGNET USING AMORPHOUS METAL MODULES AND PULSED MAGNET ASSEMBLY

(71) Applicants: Woo Sang Lee, Daejeon (KR); Jin Woo Shin, Daejeon (KR); Soo Yong Park, Brevard, NC (US)

(72) Inventors: Woo Sang Lee, Daejeon (KR); Jin Woo Shin, Daejeon (KR); Soo Yong Park, Brevard, NC (US)

(73) Assignee: Agency for Defense Development (KR)

( * ) Notice: Subject to any disclaimer, the term of this patent is extended or adjusted under 35 U.S.C. 154(b) by 0 days.

(21) Appl. No.: 13/648,351

(22) Filed: Oct. 10, 2012

(65) Prior Publication Data

US 2013/0099882 A1 Apr. 25, 2013

(30) Foreign Application Priority Data

Oct. 21, 2011 (KR) ..... 10-2011-0108367

(51) Int. Cl.
*H01F 5/00* (2006.01)

(52) U.S. Cl.
USPC ..... 335/299

(58) Field of Classification Search
USPC ..... 335/296–299, 302–306
See application file for complete search history.

(56) References Cited

U.S. PATENT DOCUMENTS

| | | | | |
|---|---|---|---|---|
| 4,734,975 | A * | 4/1988 | Ballard et al. | 29/606 |
| 6,552,639 | B2 * | 4/2003 | Decristofaro et al. | 335/216 |
| 2005/0258705 | A1 * | 11/2005 | Berwald et al. | 310/216 |
| 2006/0163971 | A1 * | 7/2006 | Gunderson | 310/267 |
| 2011/0095642 | A1 * | 4/2011 | Enomoto et al. | 310/216.045 |

* cited by examiner

*Primary Examiner* — Bernard Rojas
(74) *Attorney, Agent, or Firm* — Ostrolenk Faber LLP

(57) ABSTRACT

A pulsed magnet includes a cylindrical coil part having a hollow opening, and amorphous metal modules disposed along an outer circumference of the coil part and extending in a normal direction, which results in facilitation of cooling and minimization of generation of an eddy current.

9 Claims, 2 Drawing Sheets

PULSED MAGNET USING AMORPHOUS METAL MODULES AND PULSED MAGNET ASSEMBLY

CROSS-REFERENCE TO RELATED APPLICATION

Pursuant to 35 U.S.C. §119(a), this application claims the benefit of earlier filing date and right of priority to Korean Application No. 10-2011-0108367, filed on Oct. 21, 2011, the contents of which is incorporated by reference herein in its entirety.

BACKGROUND OF THE INVENTION

1. Field of the Invention

This specification relates to a pulsed magnet using amorphous metal modules.

2. Background of the Invention

An electromagnet (magnet) is a device to produce a magnetic field in response to a current flowing on a specific type of wire.

A representative magnet is a solenoid magnet. In the solenoid, when a current is applied onto a coil, on which a wire is spirally wound, a magnetic field is produced in proportion to the number of winding of the wire in an axial direction of the coil and strength of the current applied on the coil.

Those electromagnets, unlike a permanent magnet, are applicable in various manners, such as controlling a current to generate a magnetic field at the required moment, and adjusting strength of a current to randomly adjust strength of a magnetic field.

Especially, specific devices, such as an accelerator for accelerating particles or a vacuum tube for generating electromagnetic waves, often use the electromagnets because they sometimes require a strong magnetic field in the range of several to several tens of tesla, which general magnets are unable to reach, in order to focus or accelerate electron beams.

Those electromagnets may be classified, according to operating methods, into continuous wave electromagnets and pulsed magnets.

The continuous wave electromagnet is a magnet which constantly maintains a magnetic field, which is generated using DC current, on a time axis.

On the contrary, the pulsed magnet generates a pulsed magnetic field by applying a pulsed current only at the moment that the magnetic field is required.

Although the pulsed magnet requires additional components, such as a synchronization control circuit, which controls the magnet to operate at the very required moment, it has an advantage of higher energy efficiency than the continuous wave electromagnets because of a current being supplied only when required.

In particular, the pulsed magnet is useful in case of high power consumption or short pulse duration, which results from the requirement of a strong magnetic field.

The pulsed magnet operates in response to a current applied via a pulse power supplier including a charger, a battery, a switch and the like, and a trigger signal generator for operating a switch.

The pulsed magnet may include one coil or alternatively several layers of coils for supplying a uniform magnetic field to a long section.

A pulsed magnet operating with high output power (high energy) generates heat. In order to cool a general electromagnet, a section of a coil may increase or a fine conductive cooling channel may be created between coils or integrally with the coil. However, if the coil becomes thicker for cooling, it easily causes an eddy current to be generated due to a pulsed current. Therefore, this manner is not appropriate for the pulsed current having a fast rising time. Also, an electromagnet, which focuses electron beams within a vacuum tube generating electromagnetic waves, requires extremely high uniformity and purity of the magnetic field.

That is, fine electron beams, each of which is several mm thick, go within an error range of a unit of um according to a focusing magnetic field. Accordingly, the uniformity of the magnetic field has to be maintained within an error range of 1~2%, and magnetic fields except for a magnetic field formed in an axial direction have to be eliminated as much as possible. In addition to the eddy current, is winding of a coil may affect the uniformity and purity of the magnetic field. That is, when the coil is wound in a spiral manner, there are also finely present an axial component as well as a circumferential component. This may result in generation of an axial current component, followed by generation of an undesired magnetic field component in a tangential direction. The present disclosure is taking a pulsed magnet using amorphous metal modules into account to overcome the aforementioned problems.

SUMMARY OF THE INVENTION

Therefore, to address the related art problems, an aspect of the detailed description is to provide a pulsed magnet capable of minimizing generation of an eddy current.

To achieve these and other advantages and in accordance with the purpose of this specification, as embodied and broadly described herein, there is provided a pulsed magnet including a cylindrical coil part having a hollow opening, and amorphous metal modules disposed along an outer circumference of the coil part and extending in a normal direction.

In one aspect of the present disclosure, the amorphous metal module may have a block structure that an amorphous metal ribbon and an insulating film are laminated on each other in an alternating manner.

In one aspect of the present disclosure, the cylindrical coil part may include a first layer formed by winding a pulsed magnet coil along an outer circumference of the hollow opening in a first direction, and a second layer formed by winding the pulsed magnet coil in an opposite direction to the first direction to be laminated on the first layer.

In one aspect of the present disclosure, the pulsed magnet may further include a first case having an accommodation space for accommodating the cylindrical coil part therein, and a second case coupled to the first case in a facing manner, wherein a supporting unit may be formed on the first or second case in a shape corresponding to the shape of the amorphous metal module, to fix the amorphous metal module at an adjacent position to the cylindrical coil part.

In one aspect of the present disclosure, the pulsed magnet may further include a fixing unit configured to fix the supporting unit to the first or second case.

To achieve these and other advantages and in accordance with the purpose of this specification, as embodied and broadly described herein, there is provided a pulsed magnet assembly including a plurality of pulsed magnets laminated on each other, and at least one alignment hole formed at the pulsed magnet to align the laminated pulsed magnets, wherein the pulsed magnet may include a cylindrical coil part having a hollow opening, amorphous metal modules disposed along an outer circumference of the coil part and extending in a normal direction, a first case having an accommodation space for accommodating the cylindrical coil part therein, and a second case coupled to the first case in a facing manner, and wherein the alignment hole may be formed at the first or second case.

In one aspect of the present disclosure, the assembly may further include a supporting unit formed on the first or second case in a shape corresponding to the shape of the amorphous metal module, to fix the amorphous metal module at an adjacent position to the cylindrical coil part.

In accordance with at least one exemplary embodiment of the present disclosure, a pulsed magnet may be easily cooled and minimize generation of an eddy current.

Also, magnetic field components generated in a direction perpendicular to a rotational shaft can be attenuated by each other, thereby preventing a parasitic magnetic field. In addition, with a gap between a wire and a magnet, an insulating property may be enhanced.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the detailed description.

BRIEF DESCRIPTION OF THE DRAWINGS

The accompanying drawings, which are included to provide a further understanding of the invention and are incorporated in and constitute a part of this specification, illustrate exemplary embodiments and together with the description serve to explain the principles of the invention.

In the drawings.

DETAILED DESCRIPTION OF THE INVENTION

Figure 1:
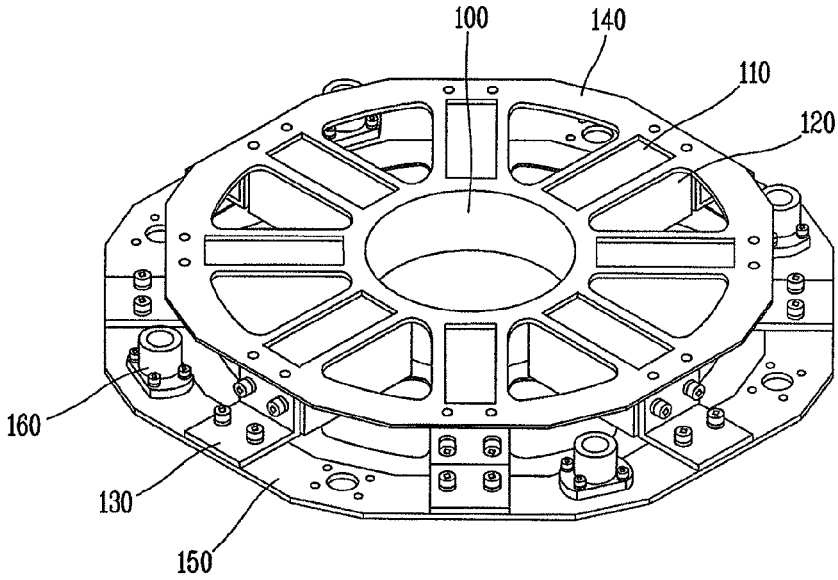
FIG. 1 is a perspective view of a pulsed magnet using amorphous metal modules in accordance with an embodiment of the present disclosure.

Description will now be given in detail of a pulsed magnet using amorphous metal modules and a pulsed magnet assembly according to the exemplary embodiments, with reference to the accompanying drawings. For the sake of brief description with reference to the drawings, the same or equivalent components will be provided with the same reference numbers, and description thereof will not be repeated.

A pulsed magnet basically includes a coil, a flux return, a cooling unit, a support structure and the like.

The coil is a component for generating a magnetic field in response to a current flowing in a spiral direction. The number of turns of a wire and strength of current are set according to a required strength of a magnetic field, and a diameter and a sectional area of the coil are set accordingly.

Whether or not to perform cooling and a cooling method are decided, taking into account an amount of current flowing on the coil, a material of the coil, a resistance value, a heat capacity and the like.

For cooling, a coil and a cooling channel may be integrally fabricated.

The flux return may serve to minimize a magnetic field leaked out of the coil and focus the magnetic field into the coil by surrounding an outside of the coil with a ferromagnetic core, which has high magnetic permeability and saturation magnetization.

Examples of the magnetic core may include a silicon thin film, an amorphous metal, a ferrite and the like.

Among others, the amorphous metal is a magnetic material made by fast cooling a molten metal, in which iron, boron, silicon and the like are mixed, namely, an alloy, in which atoms within the metal are irregularly arranged as being in a liquid state.

The amorphous metal is thin and fragile but exhibits high specific electrical resistivity and low hysteresis loss. The amorphous metal is thus used as a material of a core of a transformer.

As compared with a general crystalline magnetic material, one outstanding characteristic of the amorphous magnetic alloy is that it has no magneto crystalline anisotropy of exhibiting different magnetisms according to a crystalline direction because of no presence of a crystalline structure. This causes a relatively great affection by induced magnetic anisotropy. Therefore, it has been known that different magnetisms can be acquired by applying a magnetic field during heat treatment.

That is, when a magnetic field is applied to the amorphous magnetic alloy in a circumferential direction of a toroidal magnetic core at a high temperature below a curie temperature (Tc) of alloy, the amorphous magnetic alloy may acquire a high squareness (Br/Bs) or BS squareness ratio, which is defined as a ratio of a residual magnetic flux density (Br) to a saturation flux density (Bs). Also, when a magnetic field is applied in a height direction of a magnetic core, it may acquire a low squareness or BS squareness.

In addition, the pulsed magnet may also be classified into a single-pulsed magnet and a multi-pulsed magnet according to an operating method.

The single pulse operation is a method, in which a magnetic field is once generated by using a current charged in a pulse power supplier and a recharging time is then sufficiently taken without limitation.

Unlike to the single pulse operation, the multi pulse operation is a method of generating a magnetic field by repeating charging and discharging at a predetermined interval according to a defined pulse repetition rate. Hence, with the repetition rate increasing, fast switching of the pulse power supplier is required.

The conventional multi-pulsed magnet is able to perform the repetition of up to approximately several Hz.

A current applied to the pulsed magnet is a pulse type current having a rising time and a falling time.

The pulse type current forms a magnetic field which changes as a time elapses, and also generates a counter electromotive force (Lenz's Law). Hence, an eddy current, which interferes with the change, is generated within a conductor which is affected by the magnetic field.

The eddy current is decided by a rising time of an applied pulsed current and a thickness of the conductor.

Especially, as the repetition rate of the pulsed current increases and the pulse rising time decreases, the affection by the eddy current increases.

The eddy current generates an unexpected magnetic field, which may result in distortion of a magnetic field profile of the pulsed magnet or reduction of the strength of the magnetic field of the pulsed magnet. Also, the unexpected magnetic field may lower a switching speed of the pulse, limiting the pulse repetition rate of the magnet.

The pulsed magnet may be able to reduce power consumption rather than the continuous electromagnet, generating relatively less heat in the coil. For all that, when strength of a required magnetic field or the pulse repetition rate increases, the amount of current flowing on the coil has to increase. This may require for cooling heat which is likely to be generated by resistance.

The present disclose relates to a pulsed magnet using amorphous metal modules. Hereinafter, configuration and operation of the pulsed magnet will be described.

In accordance with one exemplary embodiment of the present disclosure, a block type amorphous metal module, which is made by laminating ferromagnetic amorphous ribbons, is applied to the pulsed magnet.

The module may exhibit several characteristics, such as a high insulating property in a laminated direction of the ribbons and high heat conductivity in a lengthwise direction of the ribbons.

With employing such principle, the present disclosure proposes a pulsed magnet, capable of preventing generation of an eddy current due to a pulsed current and acquiring a high heat radiation property by using an amorphous metal module as a flux return of the magnet, and generating uniform and highly pure pulsed magnetic field by winding a coil into double layers.

Hereinafter, description will be given of a pulsed magnet using amorphous metal modules according to the present disclosure, with reference to the accompanying drawings.

First of all, the configuration of the pulsed magnet using the amorphous metal modules will be described with reference to FIG. 1.

FIG. 1 is a three-dimensional (3D) view of a pulsed magnet using amorphous metal modules in accordance with one exemplary embodiment. The pulsed magnet may form a magnetic field in a direction of a rotational shaft of a coil 100 in response to a current applied onto the coil 100 shown in FIG. 1.

Here, the pulsed magnet may include amorphous metal modules 110 arranged along an outer circumference of the coil 100 and each serving as a flux return.

An amorphous metal tends to be fragile. Accordingly, the pulsed magnet may need mechanical structures, such as supporting units 120 for supporting the modules 110, and fixing units 130 for fixing the supporting units 120 onto a housing.

In order to assembly the amorphous metal modules 110 with the coil 100, the pulsed magnet may further include a first case 140, a second case 150 coupled to the first case 140 in a facing manner. The supporting units 120 may be installed at one of the cases 140 and 150.

The magnetic field may be formed to surround the coil 100. A magnetic flux coming outside the coil 100 may be focused into the modules which are made of a ferromagnetic material. Consequently, an external leakage of the magnetic field may be prevented, and the magnetic field within the coil 100 may be more leveled.

For an accurate alignment between layers when the pulsed magnets are constructed with several layers, alignment holes 160 may be provided.

As the alignment holes 160 are provided on the case of each pulsed magnet, a pulsed magnet assembly that the plurality of pulsed magnets are laminated on each other may prevent the generation of the eddy current and acquire a high heat transfer property.

The pulsed magnet assembly as the multi-layered pulsed magnets may include at least one alignment hole formed on each pulsed magnet for alignment of the plurality of pulsed magnets laminated on each other. Each of the pulsed magnets may include a cylindrical coil having a hollow opening, amorphous metal modules disposed along an outer circumference of the coil and extending in a normal direction, a first case having an accommodation space for accommodating the cylindrical coil therein, and a second case coupled to the first case in a facing manner. The at least one alignment hole may be formed either on the first case or on the second case.

Hereinafter, an operating effect of the amorphous metal modules will be described with reference to FIG. 2.

Figure 2:
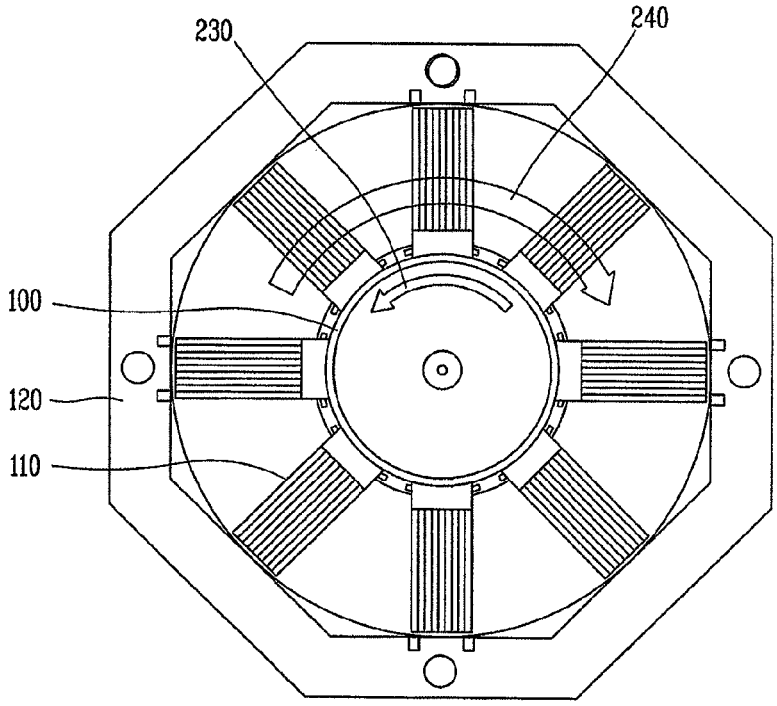
FIG. 2 is a conceptual view showing the pulsed magnet using the amorphous metal modules in an axial direction.

FIG. 2 is a conceptual view showing the pulsed magnet using the amorphous metal modules in an axial direction.

When a pulsed current 230 is applied to the coil 100 in a counterclockwise direction, a magnetic field which changes on a time basis is formed in an axial direction, and an eddy current 240 which interferes with the change may be generated at a conductor located outside the coil 100 due to a counter electromotive force.

The eddy current may interfere with the formation of the magnetic field and lower purity of the magnetic field. This may cause a limitation on applying a pulsed current signal, which changes fast, and make it hard to increase a pulse repetition rate.

In accordance with the present disclosure, to prevent the generation of the eddy current, the amorphous metal modules 110 may be disposed along an outer circumference of the coil such that such that a surface of the ribbon of each module faces in the normal direction of the circumference.

As the direction that the eddy current is going on is perpendicular to the ribbon grains of the amorphous metal modules 110, the module 110 may have a thin thickness and high insulating property by virtue of an insulating film or coating film interposed between the ribbons, which are several μm thin, effectively reducing the generation of the eddy current.

When the use of the amorphous metal modules 110 derives resistance against the time-based change in response to the current applied to the pulsed magnet, a pulsed current with a fast pulse rising time and a high repetition rate may be used, enhancing the repetition rate of the pulsed magnet.

Also, as the amorphous metal modules 110 are attached onto the outer circumference of the coil 100 using their high heat conductivity in a lengthwise direction of the ribbons, heat generated from the coil may be easily transferred up to the magnet supporting unit 120 as well as the amorphous metal modules 110. This may be advantageous in heat radiation.

This method may result in non-use of a cooling apparatus for a magnet and reduction of a capacity of the cooling apparatus, allowing a simple air cooling.

Hereinafter, description will be given of a configuration of the amorphous metal module with reference to FIG. 3.

The amorphous metal module may be fabricated by laminating amorphous metal ribbons 111 using an insulating film or coating layer 112, followed by heat treatment.

Figure 3:
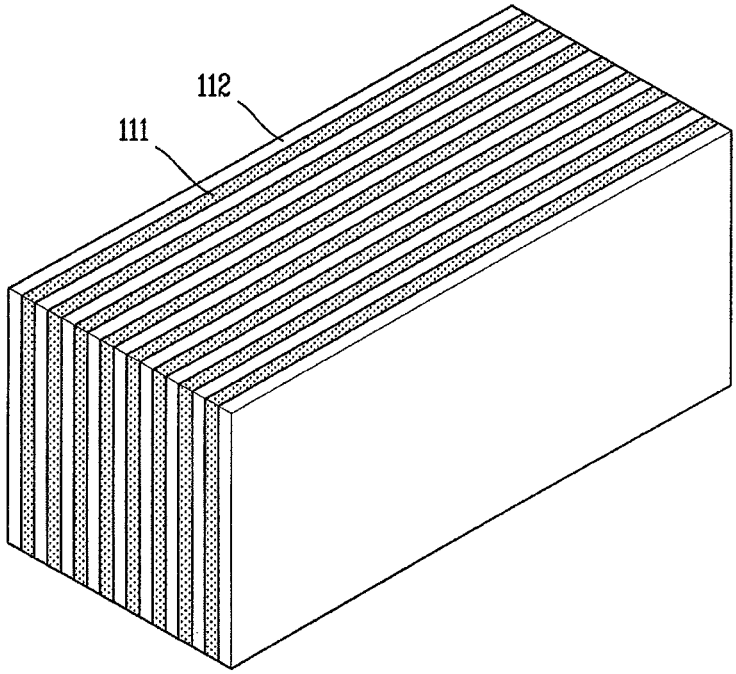
FIG. 3 is a conceptual view of the amorphous metal module in accordance with the exemplary embodiment of the present disclosure.

Unlike a general amorphous metal core for transformers on which is wound in a toroidal or circular form, the amorphous metal module for a pulsed magnet according to the present disclosure may be fabricated, as shown in FIG. 3, merely by cutting the laminated amorphous metals into a square block form with a predetermined length, facilitating fabrication of the amorphous metal module.

The proposed amorphous metal module may have a simple block structure and a smaller size than the core. This may complement a mechanical intensity of the amorphous metal which tends to be fragile and an entire weight of the pulsed magnet may be reduced.

Hereinafter, a coil winding method for the pulsed magnet will be described with reference to FIG. 4.

Figure 4:
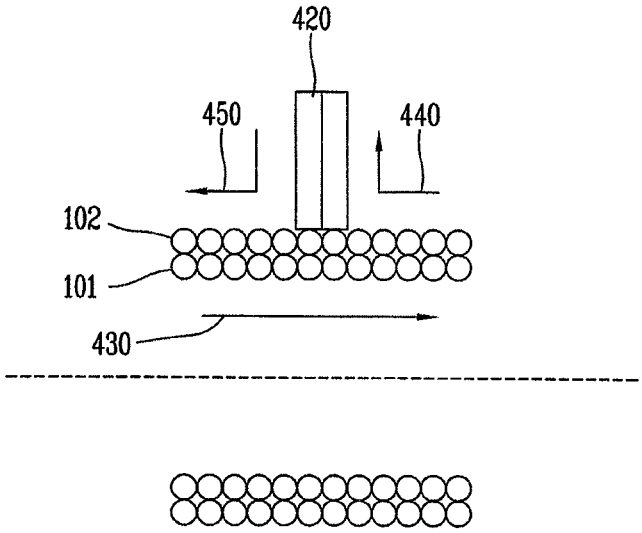
FIG. 4 is a sectional view of a coil of the pulsed magnet in accordance with the exemplary embodiment of the present disclosure.

FIG. 4 is a view showing a section of a cylindrical coil and input and output wires 420.

A cylindrical coil part includes an inner first coil 101 and an outer second coil 10 formed by winding a coil into two layers in a radial direction.

When the coil is spirally wound based on a rotational shaft, the inner first coil 101 is wound up in a right direction 430 of FIG. 4, and the outer second coil 102 is wound in a left direction 440, 450 such that the input and output wires 420 can intersect with each other.

Here, the winding directions of the first and second coils 101 and 102 may be swapped with each other.

As such, the first coil and the second coil may be wound in opposite directions so as to generate different undesired axial currents from each other. Accordingly, the axial current induced by the first coil and the axial current induced by the second coil flow in different directions, so as to be attenuated by each other, preventing formation of a parasitic magnetic field formed by the coil.

Also, the current input and output wires 420 may be located in a center of the cylindrical coil so as to define a spaced gap between a conductive wire on which a strong pulsed current flows and a magnet, increasing an insulating property.

The foregoing embodiments and advantages of a pulsed magnet using amorphous metal modules and a pulsed magnet assembly are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A pulsed magnet comprising:

a cylindrical coil part having a hollow opening; and amorphous metal modules disposed along an outer circumference of the coil part and extending in a normal direction, wherein the cylindrical coil part comprises:

a first layer formed by winding a pulsed magnet coil along an outer circumference of the hollow opening in a first direction; and a second layer formed by winding the pulsed magnet coil in an opposite direction to the first direction to be laminated on the first layer.

2. The magnet of claim 1, wherein the amorphous metal module has a block structure that an amorphous metal ribbon and an insulating film are laminated on each other in an alternating manner.

3. The magnet of claim 2, wherein the amorphous metal ribbons are perpendicular to a direction that the eddy current is going on.

4. The magnet of claim 1, further comprising: a first case having an accommodation space for accommodating the cylindrical coil part therein; and a second case coupled to the first case in a facing manner, wherein a supporting unit is formed on the first or second case in a shape corresponding to the shape of the amorphous metal module, to fix the amorphous metal module at an adjacent position to the cylindrical coil part.

5. The magnet of claim 4, further comprising: a fixing unit configured to fix the supporting unit to the first or second case.

6. A pulsed magnet assembly having at least a pulsed magnet, wherein the pulsed magnet comprises:

a cylindrical coil part having a hollow opening;

amorphous metal modules disposed along an outer circumference of the coil part and extending in a normal direction;

a first case having an accommodation space for accommodating the cylindrical coil part therein; and a second case coupled to the first case in a facing manner, wherein a supporting unit is formed on the first or second case in a shape corresponding to the shape of the amorphous metal module, to fix the amorphous metal module at an adjacent position to the cylindrical coil part, and wherein the pulsed magnet further comprises a fixing unit configured to fix the supporting unit to the first or second case.

7. The assembly of claim 6, further comprising:

a supporting unit formed on the first or second case in a shape corresponding to the shape of the amorphous metal module, to fix the amorphous metal module at an adjacent position to the cylindrical coil part.

8. The assembly of claim 6, wherein the amorphous metal module has a block structure that an amorphous metal ribbon and an insulating film are laminated on each other in an alternating manner.

9. The assembly of claim 6, wherein the cylindrical coil part comprises:

a first layer formed by winding a pulsed magnet coil along an outer circumference of the hollow opening in a first direction; and a second layer formed by winding the pulsed magnet coil in an opposite direction to the first direction to be laminated on the first layer.

* * * * *